United States Patent [19]

Rosser

[11] 3,948,575

[45] Apr. 6, 1976

[54] DRILL PIPE AND DRILL COLLAR CONTAINING MOLDED CASING PROTECTOR AND METHOD OF PROTECTING CASING THEREWITH

[76] Inventor: Eugene P. Rosser, 1231 Americana Bldg., Houston, Tex. 77002

[22] Filed: Oct. 24, 1974

[21] Appl. No.: 517,499

[52] U.S. Cl. ..... 308/4 A; 166/241

[51] Int. Cl.[2] ..... F16C 1/26

[58] Field of Search ..... 308/4 R, 4 A, 6 R, 6 A, 308/DIG. 8; 166/241, 242, 243, 173; 175/325, 323

[56] References Cited

UNITED STATES PATENTS 3,063,760 11/1962 Gifford ..... 308/4 A 3,560,060 2/1971 Morris ..... 308/4 A

*Primary Examiner*—M. H. Wood, Jr.
*Assistant Examiner*—Gene A. Church
*Attorney, Agent, or Firm*—Arnold, White & Durkee

[57] ABSTRACT

A string of drill pipe having lengths of pipe connected by enlarged couplings and operable in a well casing has located between couplings casing protectors comprising annular rings of an oil impermeable and gas impermeable synthetic resin molded around the drill pipe. The casing protectors have a slick, hard outer surface for substantially non-damaging contact with the casing.

The casing protectors can be molded about drill collar to also provide protection against damage to well casing.

18 Claims, 5 Drawing Figures

FIG.1
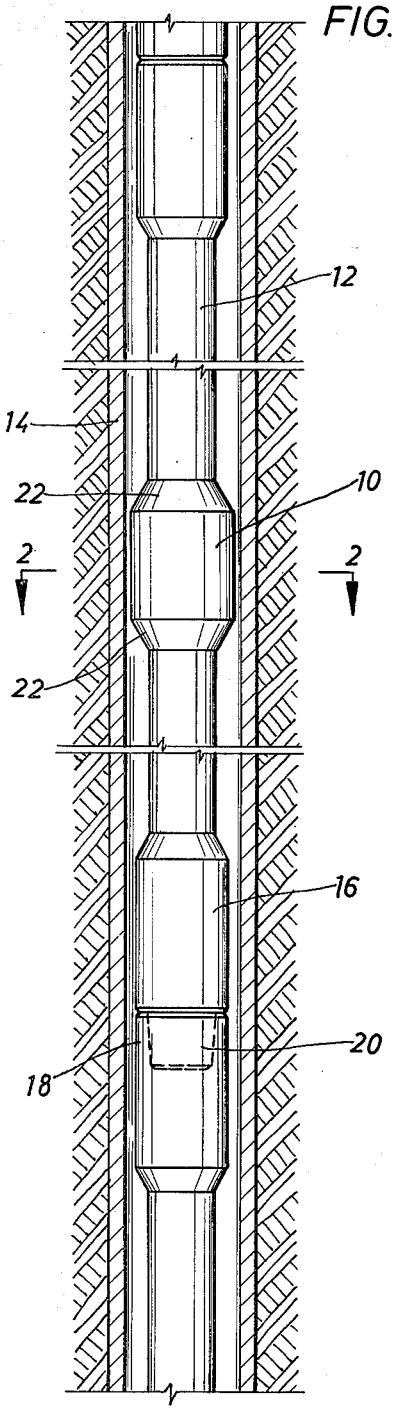
FIG.5
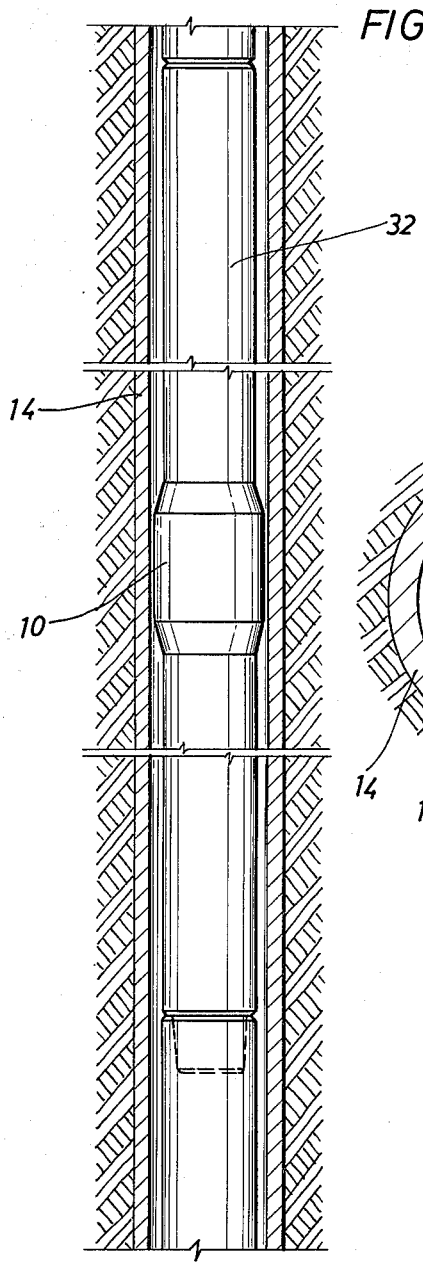
FIG.2
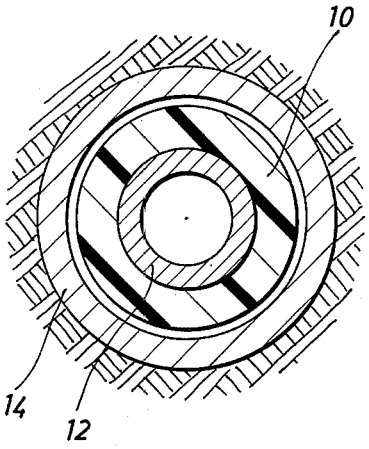
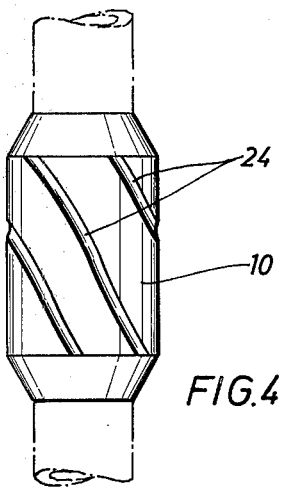
FIG.4
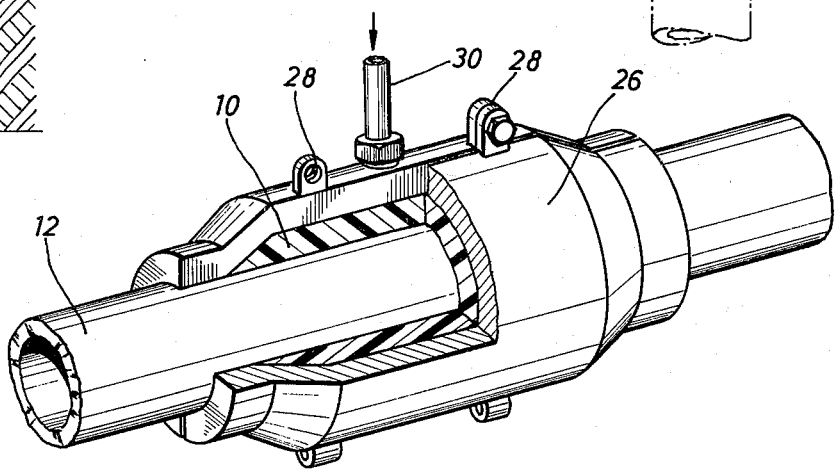
FIG.3

DRILL PIPE AND DRILL COLLAR CONTAINING MOLDED CASING PROTECTOR AND METHOD OF PROTECTING CASING THEREWITH

BACKGROUND OF THE INVENTION

1. Field of the Invention

This invention relates to a molded casing protector and, in particular, a drill pipe, string of drill pipe or drill collar having molded thereto casing protectors comprising annular rings of an oil impermeable and gas impermeable synthetic resin. More particularly, the present invention relates to such drill pipe or drill collar and a method of protecting well casing from damage, wherein the drill pipe has molded thereto casing protectors comprising annular rings of an oil impermeable and gas impermeable synthetic resin, the casing protectors having a slick, hard outer surface for substantially non-damaging contact with the casing.

2. Description of the Prior Art

In the operation of rotary drilling rigs, the rotary drill pipe extends downwardly through well casing and the drill pipe is provided with a plurality of sections held together by means of coupling connectors which are of considerably larger diameter than the normal diameter of the drill pipe. When the pipe is in operation, there is the tendency that the drill rod will whip in the casing or in the hole, causing contact between the coupling connectors and the casing, having the effect of damaging or scarring the casing. Moreover, since an extremely long drill pipe is generally necessary, due to the flexibility in the drill pipe due to its length, and due to the fact that most wellbores are far from being perfectly straight, there is a tendency for the drill pipe, particularly the coupling connectors and drill collar, to strike and rub up against the casing both during the drilling operation and during withdrawal and insertion of the drill collar and drill pipe into the hole.

In the past, much of the concern has been associated with protecting the drill pipe from damage. The early attempts have involved protecting the pipe by the use of protectors such as thick rings of rubber or the like mounted on the pipe at spaced locations along its length, the bumpers serving as shock absorbing bumpers for engagement with the well casing when the pipe is forced laterally within the casing. Examples of this type of drill pipe protector can be found, for example, in the following: U.S. Pat. Nos. 1,608,873 to Werner; 1,841,929 to Barclay; 1,863,823 to Barclay; 2,045,629 to Bettis; 2,722,462 to Tschirley; and 3,588,199 to Hopmans.

The above type of drill pipe protectors suffer from various defects. For example, a quite serious defect of this general type of drill pipe protector has been the tendency for the drill pipe protector to lose its grip and slip down along the pipe, due to the lubricating action of the liquid to which the drill pipe protector is exposed in the casing. Also, such drill pipe protectors comprising thick rings of rubber require extremely long mounting times, thereby providing an economic disadvantage. Moreover, this type of drill pipe protector, as well as all others previously developed, fail to adequately cope with the environmental downhole conditions, the downhole conditions being very hot, under high pressure, with a highly abrasive atmosphere. Accordingly, the rubber drill pipe protectors have been frequently stripped off or damaged to a great extent and, even when not stripped off, moisture can work its way in between the protector and pipe, thereby causing moisture to collect and, as a result, setting up conditions for rusting. Moreover, the abrasive environment created by the presence of sand in the hole tends to increase rather than prevent damage to the casing due to the sand which becomes imbedded in the rubber drill pipe protector, causing the formation of a grinding surface in contact with the well casing.

Various attempts have been made to improve the characteristics of the rubber drill pipe protector, so as to provide for a better hold between the drill pipe protector and drill pipe. One such attempt has been to inccrporate various materials within the drill pipe protector, thereby creating a product with greater strength. The use of glass fibers for this purpose is illustrated in U.S. Pat. 2,943,009 to Mirsky.

Most attempts to improve the conventional rubber pipe protector have involved some sort of metal sleeve incorporated within the rubber pipe protector, and some sort of hinge, clamp or other suitable member to act together with the metal sleeve to maintain the drill pipe protector in firm contact with the drill pipe. Examples of this type of drill pipe protector can be found, for example, in the following: U.S. Pat. Nos. 1,894,519 to McLaine; 1,940,332 to Smith; 1,965,730 to Williams; 1,965,998 to Williams; 1,974,546 to Shipley; 2,897,016 to Baker, 3,129,982 to Fawick; 3,164,216 to Hall; 3,425,757 to Minor; 3,449,022 to Minor; and 3,528,499 to Collett.

A conventional type of the foregoing drill pipe protector comprises an annular elastomeric, i.e., rubber sleeve-like body having a metallic reinforcing band imbedded therein. The outer layer or portion of the elastomeric body on the outside of the reinforcing band is usually substantially thicker than the inner layer, and therefore possesses relatively more elasticity. The necessary frictional engagement of the inner layer with the drill pipe to prevent the drill pipe protector from slipping is conventionally obtained by tensioning the protector about the drill pipe, by radially compressing the inner layer between the drill pipe and reinforcing band. In most typical drill pipe protectors of this type, the annular body and its imbedded reinforcing band are longitudinally split with the protector being constricted about the drill pipe by a latch mechanism which draws the ends of the protector together at the split.

While this type of drill pipe protector does eliminate some of the problems inherent in the use of annular ring of rubber, certain major problems still exist. In this regard, there is a serious problem in obtaining the desired frictional engagement of the inner layer against the drill pipe to prevent slippage without compressing the inner layer beyond its maximum modulus of elasticity. In this respect, when there is excessive compression of the inner layer, the elastomeric material rapidly deteriorates by losing its elasticity, resiliency and recovery capabilities thereby effectively reducing the ability of the device to act as a protector.

Because of this problem and because of the conventional utilization of rubber for both the inner and outer layers, this type of drill pipe protector is subject to the same types of problems as encountered with a stretched rubber drill pipe protector. Here again, sand grains tend to imbed in the outer rubber surface, and, as a result, the drill pipe protector acts as a grinding wheel and provides absolutely no protection for the well casing. Moreover, high pressure gas tends to impregnate the rubber, and the oil in the mud deteriorates most rubber products. Furthermore, as a result of the loss of elasticity and grip, chemicals, mud, salt water, etc. tend to get under the rubber, causing corrosion of the drill pipe. For this reason, when the drill pipe is removed from the well, it is generally necessary to remove the drill pipe protector so as to reduce as much as possible this problem of corrosion. This, of course, is costly and extremely time consuming.

One further type of protector which has been previously developed to protect drill pipe is exemplified by that type of protector which has an outer wear surface, such as a ceramic or metal outer surface. Examples of this type of protector can be found in the following: U.S. Pat. Nos. 3,480,094 to Morris; 3,667,817 to Kellner; and 3,697,141 to Garrett. This type of protector is absolutely without any function whatsoever in a well which is cased, since the outer wear surface of the protector tends to rub against and severely damage the casing. Considering the relative cost of replacing damaged casing versus the cost of replacing damaged drill pipe, much more consideration should be given to maintaining the casing free from damage.

As evident from the above, most previous devices have focused on protecting the drill pipe from damage, rather than protecting the casing from damaging contact with the drill pipe, specifically, the coupling connectors of the drill pipe. Certainly, it can be concluded that these previous attempts have been ill focused, and, noting this, the present invention has endeavored to eliminate the deficiencies of the prior art by providing a casing protector free from the disadvantages described above which, in addition to protecting the casing from damage in contact with the drill pipe or drill collar, further protects the drill pipe and drill collar from damage and corrosive attack.

SUMMARY OF THE INVENTION

The present invention eliminates the foregoing disadvantages and drawbacks of prior art proposals by providing a well casing protector, the well casing protector being molded around a drill pipe or drill collar. In one embodiment of the present invention, a string of drill pipe having lengths of pipe connected by enlarged couplings and operable in a well casing has molded around the periphery thereof, between couplings, annular rings of an oil impermeable and gas impermeable synthetic resin as a casing protector, such casing protector having an outside diameter greater than the outside diameter of the enlarged couplings, the casing protector providing a slick, hard outer surface for substantially non-damaging contact with the casing. Preferably, such casing protector comprises a molded epoxy resin, optionally containing a minor amount of a lubricity increasing additive.

The casing protector may have a continuous outer surface, or, where there is a close clearance between the casing protector and casing, grooves may be formed in the outer surface of the casing protector for the non-obstructed passage of mud.

In a further embodiment of the present invention, the above described casing protector is molded about the outer periphery of drill collar so as to prevent damage to the casing when the drill collar comes in contact therewith. Here again, the casing protector is a molded annular ring of oil impermeable and gas impermeable synthetic resin, providing a slick, hard outer surface for substantially non-damaging contact with the well casing.

In accordance with the method of the present invention, well casing is protected from damage due to contact between the inner surface of the well casing and the outer surface of coupling connectors for drill pipe during a drilling operation by molding around lengths of drill pipe between coupling connectors casing protectors of an oil impermeable and gas impermeable synthetic resin.

By providing a casing protector comprising a molded synthetic resin which is oil impermeable and gas impermeable, the disadvantages described above are eliminated in that the molding provides a firm bond between the drill pipe or drill collar and casing protector and the casing protector is not subjected to deterioration or damage due to the environment, i.e., gas, oil, mud, salt water, etc. This further eliminates the problem of corrosion of the drill pipe and eliminates the need to remove the casing protector from the drill pipe upon withdrawal of the drill pipe from the well. Moreover, the hard, slick surface of the casing protector prevents sand from imbedding therein as it can in a rubber drill pipe protector, thereby eliminating damage to the casing. A further advantage achieved in accordance with the present invention is that when the casing protector is worn down by friction, it is unnecessary to totally replace the casing protector, and additional gas impermeable and oil impermeable synthetic resin can be molded upon the remaining casing protector.

The present invention differs from most previous attempts in providing effective protection of the well casing from damage, a feature almost totally overlooked in previous drill pipe protectors which have as their principal objective the protection of the drill pipe from damage. The casing protector of the present invention also protects the drill pipe from damage and from corrosion. It therefore completely eliminates the drawbacks and deficiencies of the prior art.

While it has been previously proposed to provide in situ vulcanization of rubber, as, for example, in the production of a sub stabilizer (note U.S. Pat. No. 2,286,716 to Clark), the present invention has for the first time provided a molded casing protector, which molded casing protector has all of the advantages enumerated above.

Accordingly, it is a principal feature of the present invention to provide a casing protector and drill pipe and drill collar containing the same wherein the casing protector eliminates the deficiencies and drawbacks associated with previously proposed drill pipe protectors.

It is a further feature of the present invention to provide a drill pipe having molded thereto around the entire periphery thereof, between the ends thereof, a casing protector which comprises an annular ring of an oil impermeable and gas impermeable synthetic resin, the casing protector having a slick, hard outer surface for substantially nondamaging contact with well casing.

It is yet a further feature of the present invention to provide a string of drill pipe having lengths of pipe connected by enlarged couplings and operable in a well casing, wherein the string of drill pipe has between couplings casing protectors comprising annular rings of an oil impermeable and gas impermeable synthetic resin molded around the drill pipe.

Yet a further feature of the present invention lies in such drill pipe and string of drill pipe wherein the casing protector comprises a molded epoxy resin.

A still further feature of the present invention resides in a drill collar having molded thereto around the entire periphery thereof a casing protector comprising an annular ring of an oil impermeable and gas impermeable synthetic resin, the casing protector providing a slick, hard outer surface for substantially non-damaging contact with well casing.

A still further feature of the present invention resides in a method of protecting well casing from damage due to contact between the inner surface of the well casing and the outer surface of coupling connectors for drill pipe during a drilling operation, which comprises molding around lengths of drill pipe between coupling connectors casing protectors comprising an oil impermeable and gas impermeable synthetic resin, preferably a molded epoxy resin.

Yet further features and advantages of the present invention will become more apparent from the following more detailed description thereof in association with the drawings.

BRIEF DESCRIPTION OF THE DRAWINGS

In the drawings which illustrate various embodiments of the present invention in non-limiting fashion:

FIG. 1 is a partial cross-sectional view illustrating drill pipe within a casing, the drill pipe including a casing protector as in accordance with the present invention;

FIG. 2 is a cross-sectional view of the drill pipe and casing protector of FIG. 1 taken along line 2—2;

FIG. 3 is a partial cross-sectional view illustrating the molding of the casing protector of the present invention onto drill pipe;

FIG. 4 is a perspective view of an alternate embodiment of the casing protector of the present invention; and FIG. 5 is a view in partial cross-section illustrating the use of a casing protector on drill collar.

DESCRIPTION OF PREFERRED EMBODIMENTS

Referring to FIG. 1, a casing protector 10 in accordance with the present invention is shown attached to a drill pipe 12 inside an oil well casing 14. In actual practice, the casing 14 and drill pipe 14 may extend a considerable distance down into the earth, and, as a result, the pipe is generally quite flexible over its entire length.

As illustrated in FIG. 1, a plurality of drill pipes 12 are attached by means of coupling connectors 16 to form a drill string. As illustrated, coupling connectors 16 have enlarged outer diameters in comparison with drill pipe 12. Accordingly, due to the flexibility of the drill string and due to the fact that in most cases the wellbore deviates from a straight line, there is a tendency for the coupling connectors 16 to rotate against the well casing 14 during the drilling operation. This, of course, causes a problem of wear, which is most pronounced in connection with the well casing which is difficult and expensive to replace.

As illustrated, the drill pipe 12 has at one end a box end 18, and at the other, a pin end 20. These are joined to form the coupling connector 16 which couples the lengths of drill pipe 12 of the drill string.

An essential feature of the present invention is that casing protector 10 is molded directly to drill pipe 12. In this respect, the casing protector 10 comprises an annular ring of an oil impermeable and gas impermeable synthetic resin molded around drill pipe 12 and having adhesive affinity for the steel of the drill pipe. In accordance with the present invention, the casing protector 10 has a slick, hard outer surface for substantially non-damaging contact with casing 14.

As illustrated, casing protector 10 in accordance with the present invention has an outside diameter greater than the outside diameter of the coupling connectors 16. Accordingly, where the wellbore is not straight, or where the rotation of the drill pipe causes translational movement, the casing protector 10, having a slick, hard surface, will come in contact with the inside surface of casing 14 and prevent contact between the metal casing 14 and metal coupling connectors 16. The slick, hard outer surface of the casing protector 10 is substantially friction-free, and the rotational contact between casing protector 10 and the inner surface of casing 14 does not cause any damage to the casing.

As illustrated in FIG. 1, the casing protector 10 of the present invention comprises an annular ring of oil-impermeable and gas impermeable resin, the annular ring having tapered ends 22. The angle of this taper is in no way critical to the function of the casing protector 10 of the present invention, although it has been determined that the most advantageous results are achieved when there is a 30°–60° angle, preferably about a 30° angle, between the tapered ends 22 of casing protector 10 and the main annular ring body portion thereof. Of course, other conventional configurations for this type of protector can be advantageously utilized in accordance with the present invention as long as the casing protector is molded directly to the drill pipe and is formed of an oil impermeable and gas impermeable synthetic resin.

In accordance with the present invention, the casing protector 10 can be molded from a variety of synthetic resins having the necessary characteristics enumerated above, i.e., characteristics of oil-impermeability and gas-impermeability and the further characteristic of providing a slick, hard outer surface for substantially non-damaging contact with the casing. For example, the casing protector 10, in accordance with the present invention, can be advantageously molded from an epoxy resin, the epoxy resin being a thermosetting resin containing the group

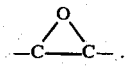

Epoxy resins can be typically prepared by condensing epichlorohydrin and bisphenol A or by condensing low molecular weight diglicidyl ethers of bisphenol A and modifications thereof. A further type of epoxy resin can be prepared by the oxidation of olefins with peracetic acid. The epoxy resins applicable in accordance with the present invention are those which, while liquid in the uncured state, form hard, solid thermosetting resins upon curing. Typically, epoxy resins can be cured with such materials as amines, polyamides, and hydrides or other catalysts, and are generally formed by mixing catalysts and epoxy with slight warming. Typically, epoxy resins can be modified by the addition of other resins compatible therewith.

A very effective epoxy resin for use in molding the casing protector of the present invention has been found to be a product identified as "Escoweld", a product of Exxon Chemical Company, U.S.A. The Escoweld epoxy resin is prepared by mixing the epoxy portion of the composition (part A) with a converter, a polyamide curing agent (part B), and allowing the resin to form a strong, hard thermosetting mass. This epoxy resin possesses the desirable oil impermeability and gas impermeability, as well as providing a slick, hard outer surface for substantially non-damaging contact with the well casing. While this material is particularly advantageous, any and all epoxy resins satisfying the above requirements can be advantageously utilized in accordance with the present invention.

The epoxy resins applicable in accordance with the present invention have great adhesive strength when molded to the metal of the drill pipe. For example, with regard to the preferred Escoweld epoxy resins, a shearing force of 2640 pounds is required to shear the casing protector from the drill pipe and a force of 258 pounds per square inch required to pull the casing protector off the metal. This illustrates the unusual bonding strength between the molded resin and drill pipe.

In addition to the applicable employment of epoxy resins as the molded casing protector, the present invention can also suitably make use of additional resins having the characteristics of oil impermeability and gas impermeability. One such resin type is a urethane resin or amino resin, a class of nitrogen-rich polymers containing nitrogen in the amino form, $NH_2$. Also, the present invention can make use of polyurethanes and polyester resins, the former being the reaction product of a polyether or polyester with a di-isocyanate, and the latter being a polymer formed by the esterification condensation of polyfunctional alcohols and acids. Any and all of these conventional resinous materials can be applicably employed in accordance with the present invention. In this respect, all that is required is that the molded resin possess oil impermeability and gas impermeability, as well as providing a hard, slick, substantially friction-free surface.

As used throughout the instant specification, the expressions "oil impermeable" and "gas impermeable" denote the characteristic that the molded resin in accordance with the present invention is not only not subject to deterioration due to oil and gas, but further, that oil and gas cannot penetrate through the casing protector, building up contaminants between the protector and drill pipe so as to form an area where corrosion can begin. Moreover, due to the hard, slick outer surface of the casing protector in accordance with the present invention, sand grains will not imbed in it, and, as a result, damage to the casing as can occur with a rubber casing protector will not come about. The hard, slick outer surface of the casing protector is, of course, a function of the synthetic resin from which the casing protector is molded and, to a lesser extent, a function of additives to the molded resin. The hardness is achieved by utilizing a resin which, unlike rubber, will not be imbedded with sand grains and can withstand the abrasive environment of the wellbore. The description of the molded casing protector as "hard" is therefore meant to convey the idea that, unlike rubber pipe protectors, the casing protector can withstand the abrasive atmosphere of the wellbore but is not in any way intended to connote any finite degree of hardness.

Similarly, the slick outer surface of the casing protector is generally a function of the synthetic resin, although it may be advantageous to include a minor amount of a lubricity increasing additive into the molded casing protector. Here again, no finite measure of lubricity is intended, although the expressions "slick" and "substantially friction-free" are meant to convey the idea that damage to the casing through frictional contact between the casing protector and casing does not occur in accordance with the present invention.

Furthermore, due to the fact that the casing protector is molded directly to the drill pipe, a firm bond is created, preventing any problem of slippage, and preventing the problem of corrosive deterioration of the drill pipe due to contaminants between the casing protector and drill pipe. Each of these advantages is brought about by the molding of the drill pipe of a casing protector comprising an annular ring of an oil impermeable and gas impermeable synthetic resin.

As illustrated in FIG. 2, in most wells, there will be a certain degree of clearance between the outer surface of the casing protector 10 and the inner surface of casing 14. This clearance will allow the passage of drilling fluids, for example, drilling mud, and, as a result, the presence of the casing protector on the drill pipe will not impede the drilling operation. However, where sufficient clearance is not present and where the drilling operation is impeded due to the lack of clearance between the casing protector 10 and drill pipe 14, the casing protector 10 of the present invention can take the form illustrated in FIG. 4.

As seen in FIG. 4, casing protector 10 of the present invention has a series of spiral grooves 24 which allow free passage of drilling fluids, such as drilling mud, between the casing protector 10 and casing. While the grooves 24 are spirally indicated in FIG. 4, it should be apparent that any groove configuration is acceptable as long as the same allows for the passage of drilling fluids. Moreover, sufficient outer surface should still be present on the casing protector 10 so as to allow non-damaging contact of the casing protector with drill casing.

FIG. 3 illustrates the method of molding the casing protector in accordance with the present invention. As illustrated, the molding of casing protector 10 is carried out with the drill pipe 12 lying horizontally in a rack, a mold 26 being placed over the drill pipe between the butt and pin ends thereof. Mold 26 can be made of hard rubber or metal and the interior thereof conforms to the shape of the casing protector 10 formed in accordance with the present invention. Generally, mold 26 is made in one piece, with appropriate clamping means 28 provided so as to create a tight seal preventing the leakage of liquid resinous material. A suitable inlet 30 is provided for the introduction of the liquid material into the mold for subsequent curing. In the case of an epoxy resin, generally two liquids will be introduced into the mold, one being the epoxy monomer, the other being a suitable catalyst. In some instances, slight warming is necessary in order to initiate the curing of the resin.

In molding the casing protector 10 to the drill pipe 12, it is generally advantageous to clean the drill pipe prior to the molding operation. In this regard, the resins applicable in accordance with the present invention all have an affinity for the steel of the drill pipe, and, as a result, a firm bond is created between the molded casing protector 10 and drill pipe 12. Moreover, in order to easily remove the mold from around the cured casing protector, it is advantageous to coat the inside of the mold with a conventional parting or release agent.

When the mold 26 is removed from about casing protector 10, the pipe 12 containing the casing protector 10 is in a form ready for use, with the possible exception of optional surface finishing of the casing protector. In this regard, some additional smoothing of the casing protector may be found advantageous, particularly in the area adjacent the opening for the introduction of the liquid resinous material.

In an additional embodiment of the present invention, as illustrated in FIG. 5, the casing protector 10 of the present invention can be molded to drill collar 32. The casing protector 10 molded to drill collar 32 has the same effect of preventing damage to casing 14 when the drill collar is utilized within the casing in a drilling operation. The form and nature of the casing protector 10 utilized in connection with the drill collar 32 is exactly the same as in connection with drill pipe 12, except, of course, for the larger inside diameter thereof.

The present invention is subject to many variations from the preferred embodiments discussed above. For example, while the above discussion indicates that the casing protector molded directly to the drill pipe or drill collar is molded from a single resin, it is applicable in accordance with the present invention to mix one or more of the above resins with additional resinous materials, so as to develop the best properties of wearability, oil impermeability and gas impermeability. The nature of the materials to be mixed, as well as the amounts of such mixture, can be developed through routine experimentation. Moreover, in order to increase the lubricity characteristics of the casing protector, it may be advantageous in some circumstances to introduce into the molded resinous casing protector a lubricity increasing additive such as graphite, molybdenum disulfide, polytetrafluoraethylene, nylon, etc. These additives are generally employed in a minor amount, i.e., up to about 20% by weight based upon the weight of the molded resinous casing protector. Accordingly, the use of any of these materials is clearly within the scope of the present invention. While the present invention has been described primarily with regard to the foregoing specific exemplification, it should be understood that the present invention cannot, under any circumstances, be deemed limited thereto, but, rather, must be construed as broadly as any and all equivalents thereof.

What is claimed is:

1. A string of drill pipe having lengths of pipe connected by enlarged couplings and operable in a well casing, said string of drill pipe having between couplings casing protectors comprising continuous annular rings of an oil impermeable and gas impermeable synthetic resin molded directly around said drill pipe, the outside diameter of said casing protectors being greater than the outside diameter of said enlarged couplings, said casing protectors having a slick, hard outer surface for substantially non-damaging contact with said casing.

2. The string of drill pipe of claim 1, wherein said casing protector comprises a molded epoxy resin.

3. The string of drill pipe of claim 1, wherein said molded casing protector contains a minor amount of a lubricity increasing additive.

4. The string of drill pipe of claim 1, wherein said casing protector has an uninterrupted outer surface.

5. The string of drill pipe of claim 1, wherein the outer surface of said casing protector includes at least one groove.

6. The string of drill pipe of claim 5, wherein said groove is helically disposed around the surface of said casing protector.

7. A drill pipe having an enlarged box end and an enlarged pin end and molded thereto, around the entire periphery thereof, between said box and pin ends, a casing protector comprising a continuous annular ring of oil impermeable and gas impermeable synthetic resin, the outer diameter of said casing protector being greater than the outer diameter of both said enlarged box end and enlarged pin end, said casing protector having a slick, hard outer surface for substantially non-damaging contact with well casing.

8. The drill pipe of claim 7, wherein said casing protector comprises a molded epoxy resin.

9. The drill pipe of claim 7, wherein said molded casing protector contains a minor amount of a lubricity increasing additive.

10. The drill pipe of claim 7, wherein said casing protector has an uninterrupted outer surface.

11. The drill pipe of claim 7, wherein the outer surface of said casing protector includes at least one groove.

12. The drill pipe of claim 11, wherein said groove is helically disposed around the surface of said casing protector.

13. A drill collar having molded directly thereto, around the entire periphery thereof, a casing protector comprising a continuous annular ring of oil impermeable and gas impermeable synthetic resin, said casing protector having a slick, hard outer surface for substantially non-damaging contact with well casing.

14. The drill collar of claim 13, wherein said casing protector comprises a molded epoxy resin.

15. The drill collar of claim 13, wherein said molding casing protector contains a minor amount of a lubricity increasing additive.

16. The drill collar of claim 13, wherein said casing protector has an uninterrupted outer surface.

17. The drill collar of claim 13, wherein the outer surface of said casing protector includes at least one groove.

18. The drill collar of claim 17, wherein said groove is helically disposed around the surface of said casing protector.

* * * * *